United States Patent [19]

Simpson

[11] 4,305,314

[45] Dec. 15, 1981

[54] TOOL FOR CHANGING MASTER PINS IN AN ALMONT LOCK

[75] Inventor: Ernest L. Simpson, Huntington Beach, Calif.

[73] Assignee: E & M Enterprises, Rio Rancho, N. Mex.

[21] Appl. No.: 163,683

[22] Filed: Jun. 27, 1980

[51] Int. Cl.[3] ..... B25B 27/00

[52] U.S. Cl. ..... 81/3 R; 29/804

[58] Field of Search ..... 29/804; 70/466; 81/3 R

[56] References Cited

U.S. PATENT DOCUMENTS

| | | | |
|---|---|---|---|
| 2,309,677 | 2/1943 | Segal | 81/3 R |
| 2,491,288 | 12/1949 | Strangman | 81/3 R |
| 3,264,908 | 8/1966 | Moore | 81/3 R |
| 3,816,899 | 6/1974 | Kitts | 81/3 R |

*Primary Examiner*—James G. Smith

[57] ABSTRACT

A partially cutaway circular cylindrical tool for changing the master pins in an Almont lock is presented. The tool is fixedly coupled at one end along its axis to a handle which may be a key handle. At the opposite end, the tool comprises a plug stop which prevents the tool from going too far into the Almont lock. The partially cutaway circular cylindrical surface defines a master pin slot, two wire slots, a wire slot ridge, a stationary pin slot, and a pin holding cam ridge, which includes a cam adjacent to the master pin slot all parallel to the axis. Perpendicular to the axis and disposed about halfway between the end of the plug stop inserted into the lock and the point of coupling between the handle and the balance of the tool is a perpendicular stationary pin slot which entends between the master pin slot and the stationary pin slot. In operation, the tool is inserted into the Almont lock and rotated so that the master pins, which are wafer tumblers, slide up the master pin slot. The tool is rotated about 90 degrees to the left. A wire is inserted into the first wire slot and the tool is removed, bringing with it the master pins, which just drop out and are retained by the tool. After removing the master pins, the top pins are still in the lock, and are not dropped. The operator next slides a wire back in through a wire slot and removes the pin dropper and then sets up the master pin system and puts the lock together. The lock now has a new set of tumblers matched to the new key.

2 Claims, 5 Drawing Figures

TOOL FOR CHANGING MASTER PINS IN AN ALMONT LOCK

BACKGROUND OF THE INVENTION

1. Field of the Invention

The present invention relates to tools for changing the master pins in an Almont lock.

2. Description of the Prior Art

The prior art discloses a wide variety of locks, both generalized and specialized. The three main branches are time locks, combination locks, and key locks. There are various combinations of the preceding, including key locks having a combination of tumblers set up for a particular key or keys, but further set up so that the combination of tumblers can be modified, so that a key which used to work no longer works, and a key which did not previously work now works. Among these are the Almont lock.

The Almont lock has the capability that the parts can be relatively easily removed from it, the tumblers reset, and reinserted, so that a new key now controls the lock. Unfortunately for a skilled locksmith, the procedure for changing an Almont lock is relatively tedious, and even for a skilled locksmith, it usually takes substantially more than 10 minutes.

The prior art discloses no simple easy to use tool which permits the changing of an Almont lock in a quick easy or convenient manner.

SUMMARY OF THE INVENTION

A tool for changing the master pins in Almont locks is presented. The tool comprises a partially cut away circular cylinder, disposed about an axis, and fixedly coupled at one end to a handle, which may be the shape of a key handle, but may have other shapes. The surface of the cylinder defines a master pin slot therethrough parallel to the axis and large enough to retain the master pins of an Almont lock, so that when the tool is inserted in the lock, the master pins of the lock are capable of falling into the master pin slot. Because the master pins fall into the master pin slot, the master pins do not obstruct movement of the cylinder during use. The master pins slot is small enough so that the slot, when used as set forth previously, does not cause binding of the top pins of the lock.

The circumferential surface of the cylinder also defines two identical cross-sectioned wire slots, the first wire slot and a second wire slot. The first wire slot is nearly adjacent to the master pin slot and separated from the master pin slot by a thin ridge aligned along a radius of the cylinder and defined by the surface of the cylinder. The wire slot is of sufficient size but not substantially larger than the sufficient size for the slideable insertion of a wire capable of holding the pins of the locks up during the operation of the tool.

On the opposite side of the master pin slot from the first wire slot, the circumferential surface of the cylinder further defines a pin holding cam ridge having a cam near the circumferential edge of the cylinder between the pin holding cam ridge and the master pin slot.

The circumferential surface of the cylinder on the side of the pin holding cam ridge opposite to the cam defines a second wire slot having a cross-section substantially identical to the first wire slot cross-section.

Nearly opposite to the second wire slot, the surface of the cylinder defines a stationary pin slot large enough to permit the stationary pin to slide in the slot when the tool is inserted in an Almont lock. The wire slot, master pin slot, stationary pin slot, wire slot ridge, pin holding cam ridge, and cam are all parallel to the axis.

The surface of the cylinder further defines a perpendicular stationary pin slot perpendicular to the axis, of size and shape the minimum capable of receiving and slideably retaining the stationary pin and extending less than 90 degrees around the circumference of the cylinder between the stationary pin slot and the master pin slot and disposed along the length of the tool near the midpoint between the end of the plugstop and the plane defining the point of coupling of the handle and the rest of the tool. The end of the tool opposite to the handle defines a plugstop which prevents the tool from being inserted too far into the Almont lock.

To modify an Almont lock using the present tool, first notch, either a master key or a change key, which is capable of operating the Almont lock by removing about one-tenth inch along the three-eights of an inch from the tip, so that the bottom of the tip of the bit has removed a volume one-tenth of an inch wide and three-eighths of an inch long. Insert the notched key in an Almont lock and open the lock. Insert a prior art locksmith retainer wire in the retainer wire slot in the cylindrical plug of the Almont lock to retain the pins in the correct position. Utilize the friction of the key to remove the cylinder plug, while retaining the wire in the slot. Insert the tool with the wire slot adjacent to the ridge disposed around the wire. Remove the wire. Push the shackle in while the lock remains in an open configuration. Rotate the tool about 90 degrees counter-clockwise so that the second wire slot is aligned at the position where the first wire slot was prior to rotation. Insert the wire back in the second wire slot to retain the driver. Remove the tool from the lock. Put the new key in the Almont lock cylinder plug which has been removed from the lock. Remaster the lock so that it will fit a new master key, as desired, by prior art methods. Put the Almont lock cylinder plug back in the lock with the wire slot of the plug aligned so as to be disposed around the slot. Remove the wire. Rotate the Almont lock cylinder plug to the locked position. The lock now functions with the new key system. A skilled locksmith can perform this change in less than a minute whereas with prior art methods the same operation usually took more than 10 minutes.

The terminology "master pin slot" and the terminology "master pins slot" are used interchangeably and refer to the same slot.

DRAWING DESCRIPTION

Reference should be made at this time to the following detailed description which should be read in conjunction with the following drawings, of which:

DETAILED DESCRIPTION

Figure 1:
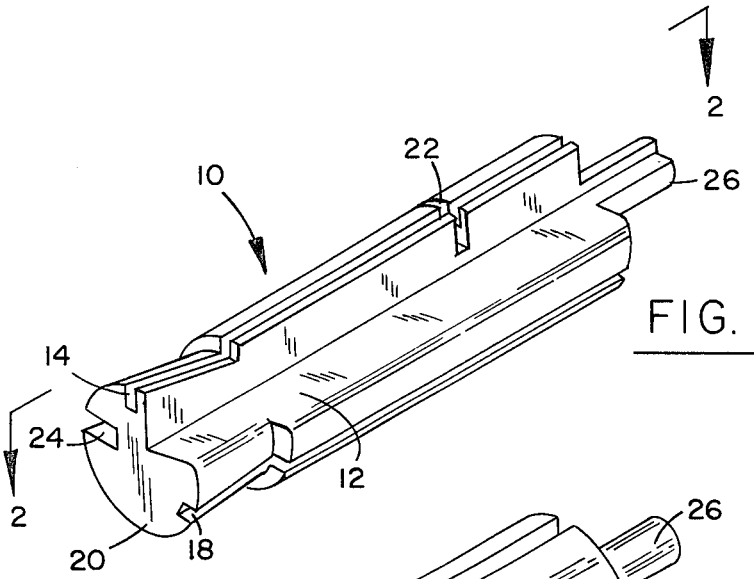
FIG. 1 is a three-quarter view of a tool for changing the master pins in an Almont lock, according to the present invention.
Figure 2:
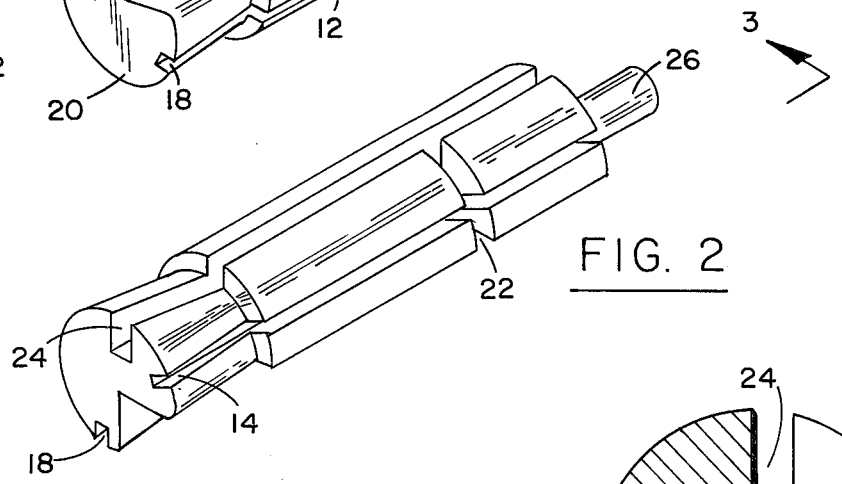
FIG. 2 is a drawing of the invention of FIG. 1 along the line 2—2.
Figure 5:
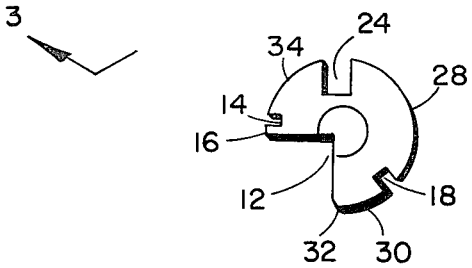
FIG. 5 is an end view drawing of the invention of FIG. 3 along the line 5—5.
Figure 4:
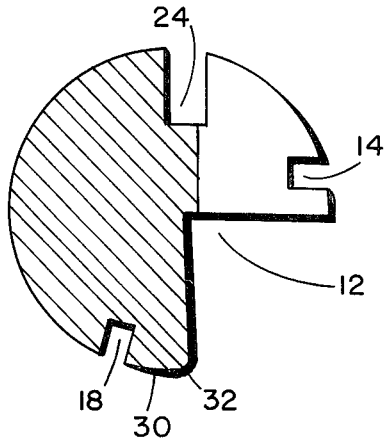
FIG. 4 is a partially cutaway view of the invention illustrated in FIG. 3 along the line 4—4.
Figure 3:
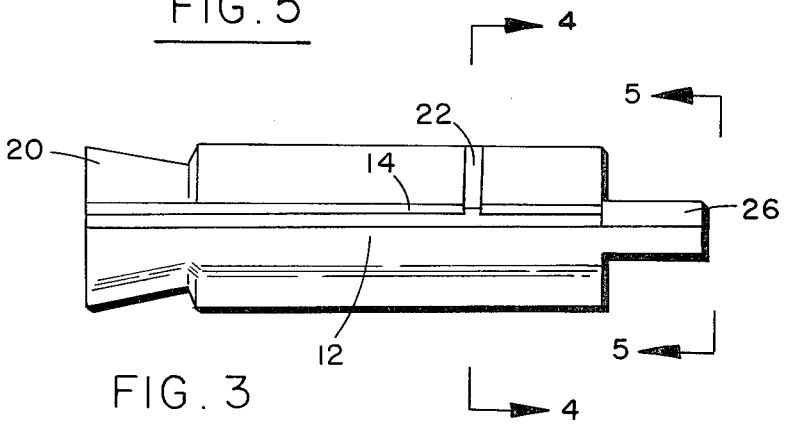
FIG. 3 is a drawing of the invention illustrated in FIG. 2 along the line 3—3.

Reference should be made at this time to FIG. 1 which illustrates a three-quarter view of a tool 10 for changing the master pins in an Almont lock (not shown). The tool 10 comprises a partially cutaway circular cylinder, fixedly coupled at a first end to a handle 20. The cylinder is coupled at its opposite end to a plug stop 26 which prevents the cylinder from being inserted too far into an Almont lock. Reference should be made at this time to FIGS. 2–5 which illustrate various other views of the example of the invention illustrated in FIG. 1.

The surface of the tool 20 also defines a relatively large master pin slot 12 which has the general shape of a right angle disposed a short distance from the axis of the cylinder so that the master pin slot 12 has a volume somewhat less than one-quarter of the volume of the cylinder. Adjacent the master pin slot 12 is a wire slot ridge 16 which separates the master pin slot 12 from a first wire slot 14.

The master pin slot 12 is large enough to retain the master pins of an Almont lock, so that when the tool is inserted in the lock, the master pins of the lock are capable of falling into the slot, so that the master pins do not obstruct movement of the cylinder. The master pin slot 12 is small enough so that the slot 12, when used as set forth previously, does not cause binding of the top pins of the lock. Other shapes of the various slots and configurations illustrated in this example of the invention are possible within limits so long as the openings and slots (not shown) as modified, are still capable of performing the functions described herein. For example, the cross-sectional shape of the master pin slot 12 can be varied from the shape shown in the present example, so long as it is large enough so that the master pins of the lock are capable of falling into the lock and not obstructing movement of the cylinder and the slot is small enough so that when used as set forth previously, the slot does not cause binding of the top pins of the lock.

The first wire slot 14 is of sufficient size, but not substantially larger than sufficient size for the insertion of a wire capable of holding the pins of the lock up during use as set forth subsequently. On the opposite side of the master pin slot 12 from the wire slot ridge 16, the circumferential surface of the cylinder 28 further defines a pin holding cam ridge 30 having a cam 32 near the circumferential edge of the cylinder between the pin holding cam ridge 30 and the master pin slot 12.

The circumferential surface 28 of the cylinder on the side of the pin holding cam ridge 30 opposite to the cam 32 defines a second wire slot 18 substantially identical in cross-section to the first wire slot 14.

Disposed approximately 180 degrees around the circumferential surface 28 from the cam 32, the surface of the cylinder 28 defines a stationary pin slot 24 large enough to permit the stationary pin to slide in the slot when the tool is inserted in an Almont lock.

The wire slots 14, 18 master pins slot 12, stationary pin slot 24, wire slot ridge 16, pin holding cam ridge 30, and cam 32 are all parallel to the axis (not shown) of the tool 10, and are disposed around the circumferential surface 28 of the tool 10. The surface 28 of the cylinder further defines a perpendicular stationary pin slot 22 perpendicular to the axis and the other slots and of size and shape the minimum capable of receiving and retaining the stationary pin of the lock and extending less than 90 degrees around the circumference of the cylinder surface 28 between the stationary pin slot 24 which is parallel to the axis and the master pin slot 12, and disposed near the midpoint between the end of the plugstop 26 and the plane defining the point of coupling of the handle 20 and the rest of the tool 10.

The terminology "master pin slot" and the terminology "master pins slot" are used interchangeably and refer to the same slot. The perpendicular stationary pin slot 22 has the general shape of a hand fan cross-section three dimensional space between two planes, two coaxial arcs of different radius, and two planes passing through the axis at approximately a 90 degree angle.

A particular example of the invention has been described. Other examples will be obvious to those skilled in the prior art. The present invention is limited only by the following claims.

I claim:

1. A tool for changing the master pins in an Almont lock, comprising:

a partially cut away circular cylinder, disposed about an axis, and fixedly coupled at one end to a handle, the surface of the cylinder defining a master pin slot therethrough parallel to the axis, two wire slots parallel to the axis, a pin holding cam ridge having a cam near the circumferential edge of the cylinder between the pin holding cam ridge and the master pin slot, a stationary pin slot parallel to the axis, and a perpendicular stationary pin slot perpendicular to the axis.

2. The invention of claim 1 wherein the master pin slot is large enough to retain the master pins of an Almont lock so that when the tool is inserted in the lock, the master pins of the lock are capable of falling into the slot, whereby, the master pins do not obstruct movement of the cylinder, and the master pin slot is small enough so that the slot, when used as set forth previously, does not cause binding of the top pins of the lock;

the first wire slot is separated from the master pin slot by a thin ridge parallel to the axis and aligned along a radius of the cylinder and defined by the surface of the cylinder and the wire slot is of sufficient size, but not substantially larger than sufficient size for the slideable insertion of a wire capable of holding the pins of the lock up;

the second wire slot is of sufficient size but not substantially larger than sufficient size for the slideable insertion of a wire capable of holding the pins of the lock up and is defined by the circumferential surface of the cylinder on the side of the pin holding cam ridge opposite to the cam and is substantially identical in cross-section to the first wire slot;

the stationary pin slot is defined by the surface of the cylinder opposite to the cam and is large enough to permit the stationary pin to slide in the slot when the tool is inserted in an Almont lock;

the perpendicular stationary pin slot is of size and shape sufficiently large to receive and retain the stationary pin and extends about 90 degrees around the circumference of the cylinder between the stationary pin slot and the master pin slot and is disposed near the midpoint of the length of the cylinder plugstop and the plane defining the point of coupling of the handle and the rest of the tool, the perpendicular stationary pin slot having the general shape of a generally fan-shaped cross-section, three dimensional space between two parallel planes, two generally perpendicular planes intersecting at an axis, and two arcs co-axial with the axis of intersection of the perpendicular planes and of different radii.

* * * * *